United States Patent [19]

Büchner

[11] Patent Number: 4,976,304

[45] Date of Patent: Dec. 11, 1990

[54] APPARATUS FOR MANUFACTURING ROLLABLE SHEET FROM METAL MELTS

[75] Inventor: Achim R. Büchner, Meerbusch, Fed. Rep. of Germany

[73] Assignee: Max-Planck-Institut fur Eisenforschung GmbH, Dusseldorf, Fed. Rep. of Germany

[21] Appl. No.: 344,515

[22] Filed: Apr. 26, 1989

Related U.S. Application Data

[63] Continuation of Ser. No. 142,728, Jan. 11, 1988, abandoned.

[51] Int. Cl.[5] ..... B22D 11/06

[52] U.S. Cl. ..... 164/428; 164/480

[58] Field of Search ..... 164/428, 480, 463, 423; 72/246

[56] References Cited

U.S. PATENT DOCUMENTS

| | | | |
|---|---|---|---|
| 4,380,262 | 4/1983 | Adler et al. | 164/423 |
| 4,577,674 | 3/1986 | Harada et al. | 164/442 |
| 4,702,300 | 10/1987 | Nakanori et al. | 164/428 |

FOREIGN PATENT DOCUMENTS

| | | | |
|---|---|---|---|
| 936671 | 11/1973 | Canada | 164/428 |
| 0138059 | 4/1985 | European Pat. Off. | 164/480 |
| 54-23030 | 2/1979 | Japan | 164/423 |
| 58-29552 | 2/1983 | Japan | 164/428 |
| 58-135718 | 8/1983 | Japan | 72/246 |
| 60-83746 | 5/1985 | Japan | 164/428 |
| 60-83747 | 5/1985 | Japan | 164/428 |

*Primary Examiner*—Kuang Y. Lin

*Attorney, Agent, or Firm*—Merchant, Gould, Smith, Edell, Welter & Schmidt

[57] ABSTRACT

There is disclosed apparatus for the continuous production of rollable sheet metal directly from molten metal comprising two cooled rollers mounted for rotation opposite one another in a substantially horizontal plane, each connected to a drive, and which are maintained a certain distance apart to form a gap of a width corresponding to the desired sheet thickness. Molten metal is poured between the two rollers in order to form a pool of molten metal above the gap. To achieve uniform operating conditions the width of the gap is adjusted automatically in dependence on the rolling force or the speed of rotation of the rollers is adjusted in accordance with the rolling pressure, for regulating the depth or volume of the molten pool.

5 Claims, 3 Drawing Sheets

3,4

APPARATUS FOR MANUFACTURING ROLLABLE SHEET FROM METAL MELTS

This is a continuation of application Ser. No. 142,728, filed Jan. 11, 1988, now abandoned.

The invention relates to apparatus for the continuous production of rollable sheet metal direct from metal melts, with two cooled rollers rotatably mounted opposite one another in a substantially horizontal plane and each connected to a drive, the rollers being maintained a certain distance apart in operation to form a gap of width corresponding to the desired sheet thickness, and with means for pouring molten metal between the two rollers in order to form a pool of molten metal above the gap.

Bessemer carried out an investigation with apparatus of this kind (Stahl und Eisen 1891, page 921 to 926). Steel strips of about one millimetre thickness about 20 centimetres width and one metre length were produced direct from molten metal and of very good surface quality at delivery rates of about twenty-five centimetres per second. All the same this method for producing metal sheets has not found its way into practical use. Possibly this is a attributable to the fact that for reasons of the production quantity efforts were made to increase the thickness of the sheet too much, resulting in major cooling problems and on failure to achieve a uniform manner of operation.

Certainly another ground (and this is the very basis of the present application) is that the process can only be carried out in a stable and reproducible manner if provision is made for suitable stabilization, basically the springing which is now proposed.

To allow apparatus of the kind stated in the introduction to operate satisfactorily in the production of rollable sheet metal, a difficult balance must be maintained: on the one hand in each unit of time as much material must be withdrawn from the pool in the form of sheet metal, as enters it in the form of molten metal. On the other hand strict requirements must be set on the depth of the pool. If it is too low the pool falls right out of the nip between the rollers in an uncontrolled manner and the sheet will have holes or even fall in pieces; if it is too great this can lead to high roller forces and these can lead in turn to the destruction of the installation as the rollers necessarily have to reduce the 'wedge' of solid material in the pool to the thickness of the gap between the rollers. Furthermore the depth of the pool must be adjusted so that a suitable cooling surface area (facing the rollers) is achieved, and thereby an acceptable cooling time.

From this it follows that to maintain the balance condition in operation it is necessary for there to be a certain degree of controllability of the depth of the pool in order to compensate for inadvertent changes in the solidifying process and/or the feed of molten metal.

The object of invention is to provide apparatus for the continuous production of rollable metal sheet direct from molten metal which is controllable or adjustable by simple means, in order to be able to operate in a balanced state even in the presence of varying operating parameters.

This object is achieved according to the invention in apparatus of the kind stated in the introduction, in that the width of the gap between the rollers is adjusted in accordance with the rolling force so that the depth of the pool returns in the direction of the desired value (the balance value) after any disturbance and resumes it again.

In other words according to the invention apparatus is proposed in which the depth or volume of the pool of molten metal poured onto the cooled rollers is set by arranging that the width of the gap between the rollers can be altered in order to maintain a continuous match between the quantity of material drawn off and the quantity fed in, and thereby to enable the apparatus to operate in a balanced state. Any variations which may arise in the thickness of the resulting sheet as a consequence of the adjustment or setting of the rolling gap are not of any practical significance because anyway after the casting the sheets are rolled before final use and any variations in thickness of the raw material are therefore corrected on rolling out.

The rollers are preferably resiliently mounted according to a force-displacement relationship which can be selected, and in fact in the simplest case in accordance with Hooke's law. Other force-displacement relationships and other technical embodiments, for example a computer-controlled hydraulic arrangement are possible when necessary. Mostly it is sufficient to provide a mounting in accordance with Hooke's law, i.e. to provide the bearing initially with a particular spring which allows the rolling gap to be adjusted automatically. Hooke's Law, as is well know by those skilled in the art, is represented by the equation $F=-kX$, wherein k is the force constant of the body being deformed, X is the displacement and F is the resulting force.

According to a preferred practical embodiment only one of the two cooled rollers is mounted in a resiliently yielding manner while the other is mounted rigidly. In this way the most economical mounting possible is obtained and also any problems in supplying cooling water are eased.

It is particularly advantageous in the case of long rollers for at least one of the two rollers to be mounted in bearings which are supported in an individually yieldingly adjustable manner so that the adjustable or yielding roller can also be adjusted in a manner which varies along its length. In this way it is possible to achieve a particularly favourable adjustment of the depth or volume of the pool of molten metal in operation.

A further possibility for achieving the balance between the input and withdrawal of material lies in regulating the speed of the rollers in a sense such that the speed is increased with rising roller pressure and vice versa. For this purpose there is provided a force-measuring transducer cell from which the signals are used directly for controlling the driving motor.

By virtue of the invention there is provided apparatus by which it is possible in a simple manner, in the production of rollable sheet metal direct from molten metal, to maintain a balanced condition in operation so that continuously or endlessly rollable sheet metal can be cast direct from molten metal.

An embodiment of apparatus according to the invention by way of example for the continuous production of rollable sheet metal direct from molten metal is illustrated in the drawing, and in fact;

DETAILED DESCRIPTION

Figure 1:
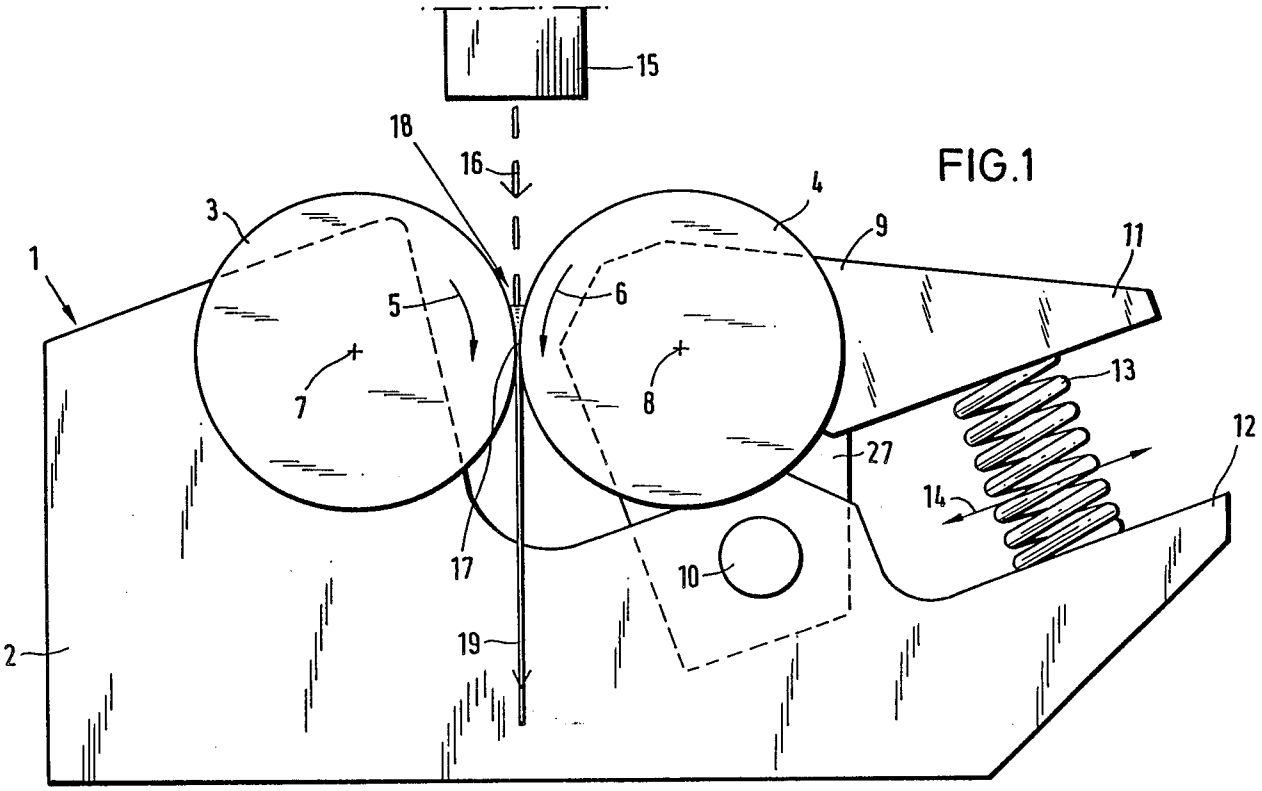
FIG. 1 is a diagrammatic side view of the apparatus.
Figure 2:
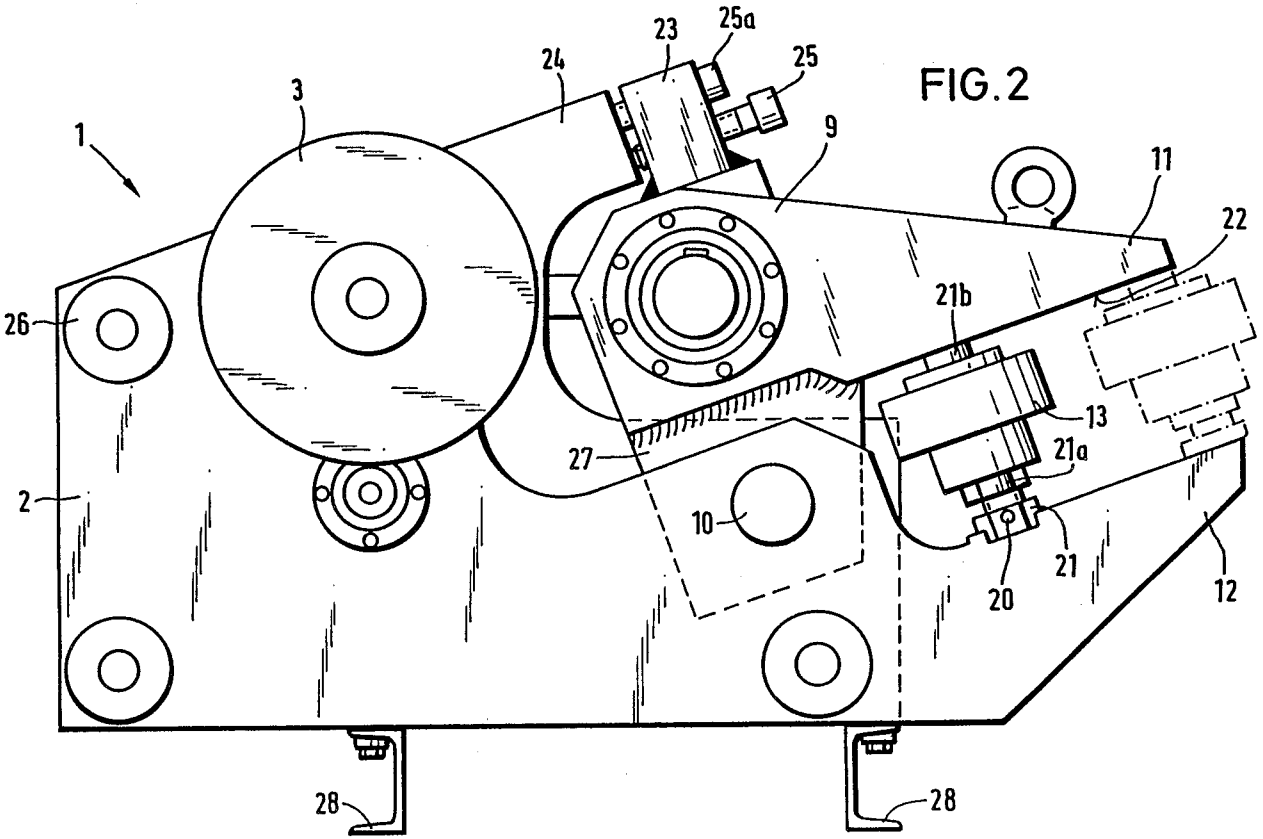
FIG. 2 is a side view similar to FIG. 1, but in which detailed constructive features are revealed.

FIG. 2 is a side view similar to FIG. 1, but in which detailed constructional features are revealed.

The apparatus 1 illustrated in the drawing has a rigid frame 2 in which two rollers 3 and 4 are rotatably mounted. Both rollers can be connected to a drive, not shown, so that they can be rotated under power and accordingly at a controlled speed in the direction of the arrows 5 and 6.

Both of the rollers 3 and 4 are provided with water cooling, not shown, and can for example dip into water troughs, not shown. However it is equally possible to make the rollers 3 and 4 hollow and to conduct cooling water through them.

The roller 3 is mounted to rotate about a fixed axis 7 in the frame 2, i.e. it is supported rigidly within the frame 2. The roller 4 is mounted to rotate about an axis 8 in a rocker assembly 9 which itself is supported to pivot in the frame 2 about an axis 10. Between an arm 11 of the rocker assembly 9 and a projection 12 on the frame 2 there is a compression spring 13, the force of which acts through the arm 11 and the assembly 9 to press the roller 4 against the pool 18 and in this way on the one hand it compensates the rolling force and on the other hand, however, it senses it and, with the aim of regulation, it transmits it to the compression spring 13.

In order to be able to vary the resistance which the compression spring 13 exerts against pivotal movement of the rocker assembly 9 the compression spring 13 is adjustable in the direction of the double arrow 14. In this way the lever arm can be altered and thereby the effective spring constant acting on the roller 4. If this variation of the spring constant is found not to be sufficient the spring 13 must be replaced by a different one.

Molten metal in the form of a thin stream 16 flows from a furnace 15 or pouring ladle arranged above the apparatus 1 and forms a pool or reservoir 18 above the gap 17 present between the rollers 3 and 4. The molten metal in the pool begins to solidify in the region of the surfaces of the rollers 3 and 4 and leaves the gap 17 in the form of a solidified sheet 19 which can be coiled up or directly treated further, in particular rolled, in a manner not shown.

From FIG. 2 it can be seen that a horizontal pivot pin 20 on the compression spring 13 has a rocking engagement against the projection 12 on the frame 2. A shoe 21 which is hooked over the projection 12 at the front and back takes care of the lateral location of the spring 13. To ensure that no unwanted displacement of the spring 13 in the longitudinal direction of the projection 12 takes place in operation, ridges are applied to the supporting surface of the projection 12, spaced a small distance apart, between which the pivot pin engages. A plunger 21*b* on the compression spring 13 engages the underside 22 of the arm 11 of the rocker assembly 9, i.e. there is no fixed connection between the arm 11 and the spring 13. Thus the spring 13 can be displaced in small steps to achieve optimum effect from fully to the left (the position shown) to fully to the right (indicated in broken lines).

The shoe 21 is the head of a hexagonal screw, provided with a groove and the pin 20 and with the aid of it in conjunction with a screwed nut 21*a* the pre-load of the spring 13 can be adjusted to the desired value. It should be made clear that for optimum adjustment of the setting therefore two magnitudes can be adjusted independently; the spring constant effective at the rolling gap and the pre-load of the spring.

The plunger 21*b* is in the form of a force-measuring transducer and in a manner known in itself it indicates the effective spring force at any time, to be read on a indicating instrument or to be employed directly for control, e.g. of the roller speed.

Secured to the upper face of the assembly 9 is a stop 23 co-operating with a shoulder 24 on the frame 2. A screw 25 serves to allow a minimum spacing between the rollers 3 and 4 to be set and maintained, in that it abuts against the shoulder 24. A screw 25*a* on the other hand is screwed into the shoulder 24 so that with its aid the rocker assembly 9 can be pulled in the direction which reduces the gap between the rollers 3 and 4. In this way a maximum gap can also be set.

The frame 2 and the rocker assembly 9 each comprise two side members arranged laterally spaced apart, of which only one is visible in the drawing.

The flanks or side members of the frame 2 are held together with the aid of supporting tie-rods 26. The lateral position of the end-pieces or flanks of the rocker assembly 9 is set such that an eye 27 present on each side member of the rocker assembly lies outside the associated side member of the frame 2.

The frame 2 is secured on transverse bearers 28 in the form of channel-section irons which can serve as feet or equally well as connecting elements for further components, not shown.

While herein before an embodiment of the invention has been described in which the central axes or axes of rotation of the two rollers are arranged in a substantially horizontal plane, the invention includes also to support the two rollers with their central axes in an inclined plane. In such embodiment, the roller arranged with its central axis in the elevated or higher position preferably has a smaller diameter than the other roller so that the pool or reservoir 18 above the gap 17 present between the two rollers is substantially in vertical position.

Figure 3:
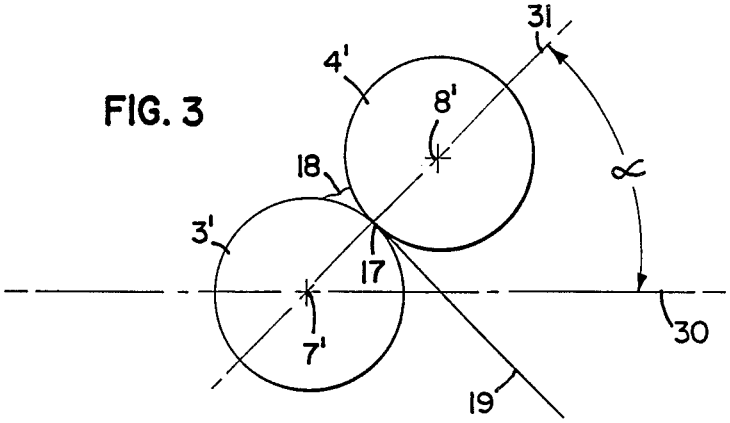
FIG. 3 is a side view of an alternative embodiment, wherein the axis of the second roller does not lie in the horizontal plane through the axis of the first roller.
Figure 4:
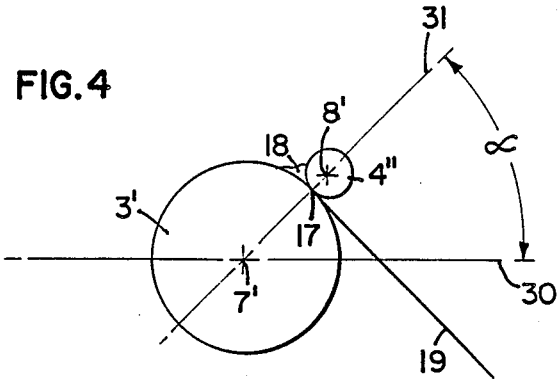
FIG. 4 is a schematic view of a second alternative embodiment, wherein the second roller is smaller than the first roller of FIG. 3.

FIG. 3 illustrates the two rollers 3′ and 4′ arranged and configured such that axis 8′ of roller 4′ does not lie in the horizontal plane 30 taken through axis 7′ of roller 3′. Therefore, plane 31, taken through axis 7′ and 8′ is inclined at an angle $\alpha$ from the horizontal plane 30. FIG. 4 illustrates the smaller diameter of roller 4″ as discussed above.

In accordance with a further embodiment of the present invention at least one of the two rollers of the apparatus is resilient in such manner that portions or sections of said roller are yieldable over or relative to other portions or sections of this one roller. Such embodiment is preferable for avoiding difficulties in controlling the gap width between the two rollers. Nowadays, with an apparatus of the present application sheet metals with a width up 1,80 meter are already produced. However, faults or other disturbances which have to be equalized appear only locally so that only local adjustments of the rollers or the gap are necessary for equalizing.

Figure 5:
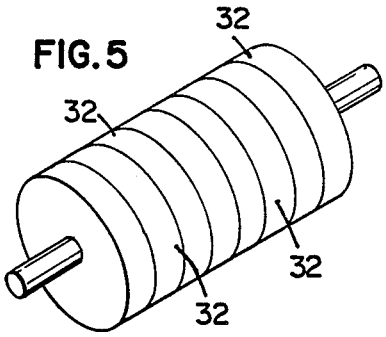
FIG. 5 is a perspective view of a third alternative embodiment, wherein the rollers are comprised of a plurality of disks.

Such local control is for instance possible if each resilient roller comprises of a number of disks 32 (best seen in FIG. 5) which are coaxially arranged side-by-side and of which each is resiliently supported independent of the other disks so that the roller in total is locally yieldable.

Another embodiment for locally adjusting the gap between the two rollers is that each resilient roller comprises a tube which is elastically deformable in order to automatically adjust it in portions or sections thereof. In other words, such roller is locally yieldable in compliance with the actual process requirements in operation of the apparatus.

What is claimed is:

1. An apparatus for continuously producing rollable sheet metal directly from molten metal by a rolling action, said apparatus comprising:

(a) two cooled rollers rotatably mounted side-by-side, at least one of said rollers mounted in a rocker assembly pivotable about an axis, said rollers forming a gap therebetween;

(b) drive means connected to each of said rollers for rotating said rollers;

(c) means for pouring molten metal between said rollers in order to form a pool of molten metal above said gap; and (d) a lever arm cooperatively attached about said axis, said lever arm compressing a spring wherein the position of said spring is adjustable along the length of said lever arm, whereby the force to be exerted by said spring may be changed by adjusting the position of said spring along said lever arm, and wherein the width of said gap is automatically adjustable for regulating the depth or volume of the molten pool in accordance with the force exerted onto said rollers by the rolling action, whereby the rolling force-gap-width relationship acts in accordance with Hooke's Law; wherein $F=-kx$, where k is the force constant of the spring, x is the deflected distance and F is the resulting force.

2. The apparatus set forth in claim 1, wherein the two rollers are supported with their central axes or axis of rotation in a plane inclined to the horizontal plane.

3. The apparatus set forth in claim 2, wherein the roller which is supported with its central axis in the elevated or higher position has a smaller diameter than the other roller.

4. The apparatus set forth in claim 7, wherein at least one said two rollers is resilient, wherein portions or sections of said one roller are yieldable over other portions or sections of said one roller.

5. The apparatus set forth in claim 4, wherein each resilient roller comprises a number of disks which are coaxially arranged side-by-side, wherein each of which are supported resiliently independent of the others.

* * * * *